US005366146A

United States Patent [19]

Haan et al.

[11] Patent Number: 5,366,146

[45] Date of Patent: Nov. 22, 1994

[54] SINGLE-PART STATEMENT MAILER

[75] Inventors: Henk Haan, Niagara Falls; Mark S. Casper, Williamsville, both of N.Y.; Martha Balshaw, Gurnee, Ill.; Kevin A. Schindler, Frederick, Md.

[73] Assignee: Moore Business Forms, Inc., Grand Island, N.Y.

[21] Appl. No.: 88,637

[22] Filed: Jul. 9, 1993

[51] Int. Cl.[5] ..... B65D 27/06; B65D 27/04

[52] U.S. Cl. ..... 229/304; 229/92.3

[58] Field of Search ..... 229/303, 304, 305, 92.1, 229/92.3

[56] References Cited

U.S. PATENT DOCUMENTS

| | | |
|---|---|---|
| 1,995,183 | 3/1935 | Kovnat . |
| 2,710,716 | 6/1955 | Deutschmeister et al. . |
| 3,143,279 | 8/1964 | Black . |
| 3,228,586 | 1/1966 | Hayes, Jr. . |
| 3,255,952 | 6/1966 | Black . |
| 3,557,519 | 1/1971 | Lyon, Jr. . |
| 3,995,808 | 12/1976 | Kehoe . |
| 4,428,526 | 1/1984 | Riley . |
| 4,437,852 | 3/1984 | Volk, Jr. et al. . |
| 4,730,767 | 3/1988 | Gendron . |
| 4,801,076 | 1/1989 | Schoenleber et al. . |
| 5,169,060 | 12/1992 | Tighe et al. . |
| 5,197,663 | 3/1993 | Stude . |

*Primary Examiner*—Stephen P. Garbe

*Attorney, Agent, or Firm*—Nixon & Vanderhye

[57] ABSTRACT

A single-ply of paper in web form continuously forms one-piece statement mailers by first die-cutting appropriate portions of the mailer to form a window for a return envelope, and inset edges for a bang-tail and payment coupon. Non-personalized and personalized information is printed on the single ply in various panels thereof. By repeating sequences of applying glue and folding the web into various panels, a complete statement with personalized and non-personalized information can be provided an addressee. Additionally, fugitive glue lines are provided in the return envelope to space the inserts, i.e., a payment coupon and remittance, from edges of the return envelope to facilitate opening of the envelope by automatic mail openers.

19 Claims, 13 Drawing Sheets

FIG. 5
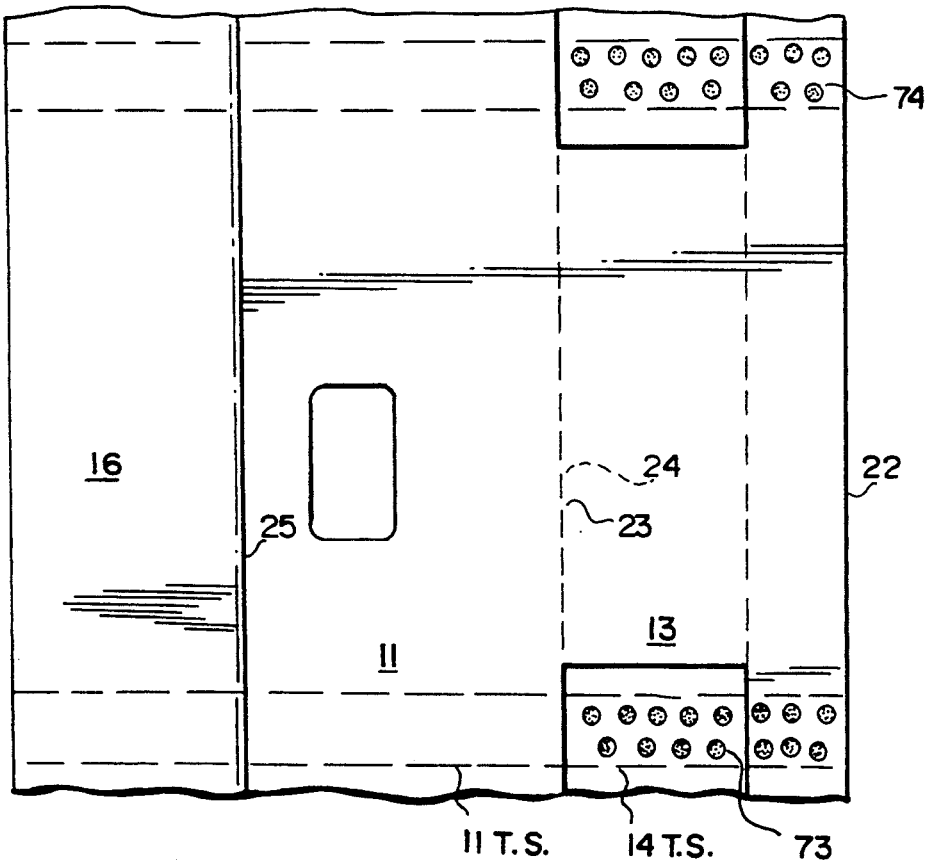
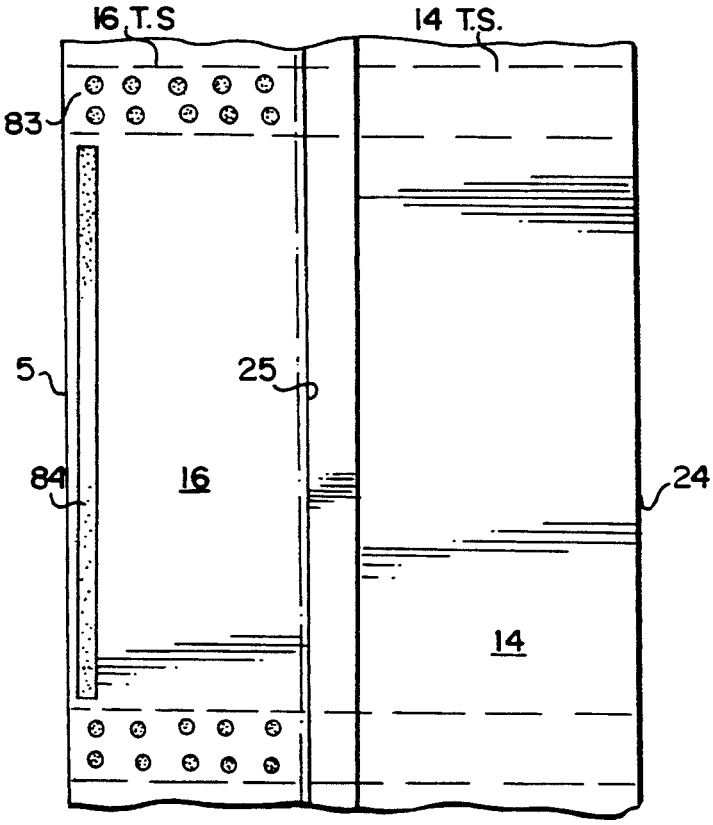
FIG. 6

FIG. 8
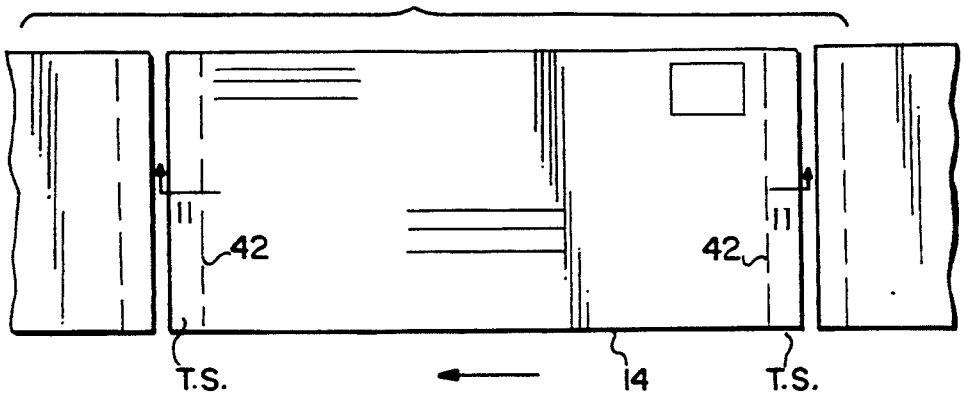
FIG. 9
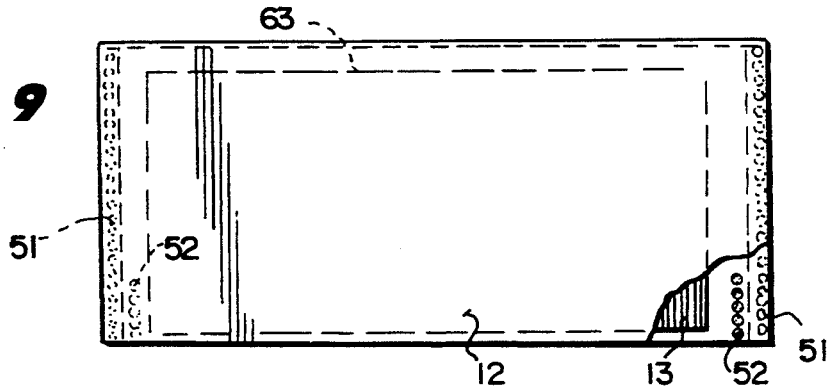
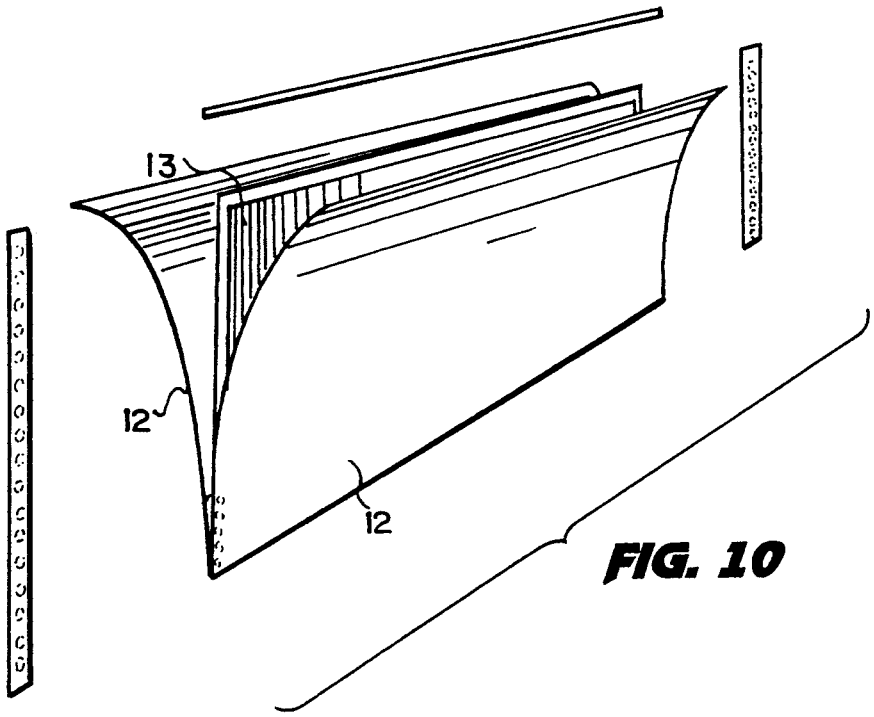
FIG. 10

HOT GLUE
46
DIE CUT
37
CUT OFF AT T.S. ON RETURN ENVELOPE
108
COLD GLUE
50
FOLD
54
PRINT
34
PRINT
32
PRINT
30
STOCK IN
36
COLD GLUE
58
FOLD
60
62
COLD GLUE
70
FOLD
80
COLD GLUE
82
FOLD
88
PERF
90
CUT-OFF UNIT
92

SINGLE-PART STATEMENT MAILER

TECHNICAL FIELD

The present invention relates to a single-part statement formed of a single ply folded to form panels which are adhered together to form a mailer, including an outgoing mailer, a business return envelope, a payment coupon and a statement, as well as to methods for forming such mailer. The present invention also relates to a mailer having a return envelope constructed to locate material inserted into the return envelope spaced from the margins of the return envelope sufficiently to permit the use of automatic high-speed letter openers without cutting or otherwise damaging the inserts. Further, the present invention provides a single-part statement capable of receiving one or more loose inserts within the panels of the mailer.

BACKGROUND

Statements, for example, credit card statement, as well as other types of business forms, are typically produced by printing a statement and inserting the statement, together with a separate return envelope, into an outgoing envelope. Thus, three separate pieces, an outgoing mail envelope, a business return envelope and the statement itself, are used. Personalized information is normally printed on the statement, such as account numbers, payments due, etc., and on the outgoing envelope. Portions of all three parts are also printed with non-personalized generic information, such as advertising information; the name and address of the company forwarding the statement, identifiers for the personalized information and other information. Separate processes and processing are required to print and collate statements of this type and this, of course, involves: substantial costs. It has been found highly desirable to form a single-part statement incorporating into a single-paper ply an outgoing mailing envelope, the statement itself, a payment coupon, if applicable, and a return envelope for the statement. Further, all necessary personalized information may be printed on the various panels of the single ply prior to folding and securing the panels to one another to form an outgoing mailer. Additionally, it is frequently desirable to provide loose inserts in the outgoing mailer for review and use by the recipient.

Still further, one of the many problems when using a return envelope containing a remittance or payment coupon, or both, is that, for high-volume mailers, high-speed letter openers are typically used to open the return envelopes. These openers typically cut off the top and side margins of the envelope in order to open the return envelope on three sides and enable extraction of its contents. Most openers are set to cut or slit at a distance approximately 1/64-inch from the sides and top of the envelope. However, in using the present mailer, the openers are preferably set at $\frac{1}{4}$ inch to ensure complete removal of the marginal stubs of the return envelope. Glue systems for mailers and return envelopes, however, are not capable of controlling the width of glue strips or end seams within high tolerances. Ordinarily, the width of the glue on one side will vary substantially, for example, between 0.06 inches and 0.18 inches. As a consequence, inserts, such as a remittance and accompanying payment coupon, frequently tend to orient themselves toward one side of the return envelope and not infrequently are cut during the automatic mail opening process. These inserts, once removed from the envelopes, are normally read automatically by an optical system. Thus, any damage to the insert caused by opening the envelope makes the insert oftentimes unreadable by the optical system, necessitating further processing of the insert by hand.

DISCLOSURE OF THE INVENTION

In accordance with the present invention, a single-paper ply in web form is divided into a series of panels and foldlines. The web is then folded and the panels adhered to one another by adhesive in alternating steps. Thus, after personalized and non-personalized information are imaged or printed on one or both sides of the ply and the single ply is die-cut, adhesive is applied to one or both (depending upon the nature of the adhesive) of first and second panels which will form a return envelope in each mailer. The continuous ply is subsequently folded to register and adhere those panels to one another, thus forming the return envelope. After the first folding, and in a first embodiment hereof, adhesive is applied to one or both of the second and fifth panels, with the ply being subsequently folded to register and adhere the second and fifth panels one to the other. Adhesive is then applied to the first and fourth panels. Subsequently, the ply is folded about registering fourth and third foldlines to register the third and fourth panels with the first, second and fifth panels and adhere the first and fourth panels to one another. Adhesive is then applied to the fourth and sixth panels whereupon they subsequently folded about a fifth foldline and adhered to one another, completing the mailer.

In a second embodiment hereof, the first and second panels are folded to form the return envelope similarly as described above in connection with the first embodiment. At this stage of the mailer forming process, however, the margins of the first and second panels are die-cut substantially parallel to or slightly inset from the locations of the lines of perforations which will form the tear strips in other panels of the complete mailer. Additionally, the next or second foldline is located between the return envelope flap and the top of the first panel. In the formation of the mailer of this second embodiment, the registering first and second panels are folded about the second foldline into registration with the third panel, i.e., the payment coupon. At this stage, all edges of the first, second, third and seventh panels are either parallel with or inset from the lines of perforations forming the tear strips in the completed mailer. The registering first, second, third and seventh panels are then folded over a third foldline to overlie the fourth panel Adhesive is then applied to one of the fourth and fifth panels in the margins thereof to secure the fourth and fifth panels to one another when the first through fourth and seventh panels are folded about a fourth foldline into registration with the fifth panel. Adhesive is then applied to the margins of the fourth or sixth panel and the panels folded about a fifth foldline to form the completed mailer.

In this second embodiment, it will be appreciated that the edges of the return envelope do not carry tear strips and that they are perfectly formed in the production of the mailer. Thus, frayed or ragged edges resulting from inadequate tearing of the tear strips by the recipient of the mailer are avoided, thereby facilitating alignment of the return envelope in automatic mail opening machinery. Also, by locating the second foldline between the top of the return envelope and the return envelope flap, there is provided a scoreline about which the return envelope flap may be folded. This avoids skewing of the flap during sealing and facilitates proper sealing thereby also affording proper alignment of the return envelope in the automatic mail opening machinery.

In the foregoing process, the adhesive is preferably a cold glue applied in spots to one of the panels to be adhered together, although it will be appreciated that other types of adhesive, for example, hot melts, and other types of adhesive configurations, such as continuous lines of glue, may be used. Also, with the exception of a rewettable adhesive applied along a return envelope flap, the adhesive is applied, preferably in spots, to the continuous web in areas of the panels which will form end tear strips for the outgoing mailer in final assembly. Thus, as used herein, the term glue "line" or "lines" embraces both a continuous line of glue or a line of glue spots spaced from one another.

Further, one or more loose inserts having both personalized and non-personalized information may be inserted into the mailer during its formation as described above. For example, in the first embodiment, loose inserts may be disposed on top of the first panel after the panels are folded about its second foldline. The subsequent foldines and adhesive applications are such as to maintain the inserts within the mailer after final assembly.

To ensure that the return statement is not damaged or cut by automatic mail opening equipment, fugitive glue lines or dots of adhesive are provided between the panels forming the return envelope. These are preferably provided adjacent the bottom of the envelope, and inset from the marginal lines of adhesive forming the side edges of the return envelope. By locating the fugitive glue in this manner, the insert or payment coupon, when located within the return envelope, resides between the fugitive glue spots on the opposite sides of the envelope and hence is spaced from the side margins of the envelope, which will be cut by the automatic mail opening equipment. This ensures that the envelope may be opened without damaging or cutting the insert.

In a preferred embodiment according to the present invention, there is provided a mailer comprising a single ply having longitudinally and transversely extending edges, first, second, third, fourth, fifth and sixth panels, and first, second, third, fourth and fifth foldlines transversely spaced one from the other and extending in a longitudinal direction, a pair of marginal lines of perforations extending transversely along the ply generally parallel to the transversely extending edges and inset therefrom, respectively, defining marginal tear strips for the mailer in the first, second, fifth and sixth panels and at least one of the third and fourth panels, the first and second panels being folded about the first foldline to register the first and second panels with one another and the marginal tear strips thereof with one another, adhesive along the registering marginal tear strips of the first and second panels to secure the registering marginal tear strips to one another, and adhesive along portions of the first and second panels inset from the marginal lines of perforations to secure the first and second panels to one another, respectively, to form a return envelope. The third, first and second panels are folded about the second foldline such that the third panel registers with the fourth panel and the first and second panels register with the fifth panel, the marginal tear strips of the second and fifth panels lying in opposition to one another and the third and fourth foldlines lying in registry with one another, adhesive along the registering marginal tear strips of the fifth and second panels to secure the fifth and second panels to one another, the registering third and fourth panels being folded about registering third and fourth foldlines to register with the registering first, second and fifth panels, adhesive along the marginal tear strips of the first panel and the one of the third and fourth panels to secure the first panel and the one panel to one another, the sixth panel being folded about the fifth foldline to overlie the fourth panel and adhesive between the sixth and fourth panels to secure the sixth and fourth panels to one another.

In a further preferred embodiment according to the present invention, there is provided a method for producing a mailer formed of a single ply having longitudinally and transversely extending edges, first, second, third, fourth, fifth and sixth panels, and first, second, third, fourth and fifth foldlines transversely spaced one from the other and extending in a longitudinal direction, comprising the steps of providing a single ply of web material, imaging information on at least one side of the web, applying first and second transverse adhesive lines along transversely extending marginal areas of the first and second panels, the first adhesive line being inset from the second adhesive line, folding the first and second panels of the web into overlying relationship with one another, with the first and second adhesive lines adhering the first and second panels to one another and said first lines of adhesive adhering said first and second panels to one another to form a return envelope, subsequently applying transverse adhesive lines along marginal areas of one of the second and fifth panels, respectively, folding the first and second panels and the fifth panel into overlying relationship with one another, and folding the third panel and the fourth panel about the third foldline into overlying relationship with one another whereby the adhesive lines applied to one of the second and fifth panels adhere the second and fifth panels to one another, subsequently applying transverse adhesive lines along marginal areas of one of the first panel and the fourth panel, folding the third and fourth panels into an overlying relationship with the first, second and fifth panels whereby the adhesive lines applied along one of the first and fourth panels adhere the first and fourth panels to one another, subsequently applying adhesive lines to marginal areas of one of the fourth and sixth panels, folding the sixth panel add the first through fifth panels into overlying relationship with one another so that the sixth panel is in juxtaposition with the fourth panel whereby the adhesive lines applied to one of said fourth and sixth panels adheres said fourth and fifth panels to one another to form a single-part statement, and severing each of the single-part statements from the web of material.

In a further preferred embodiment according to the present invention, there is provided a mailer comprising single ply having longitudinally and transversely extending edges, first, second, third, fourth, fifth and sixth panels, and first, second, third, fourth and fifth foldlines transversely spaced one from the other and extending in a longitudinal direction, a pair of marginal lines of perforations extending transversely along the ply generally parallel to the transversely extending edges and inset therefrom, respectively, defining marginal tear strips for the mailer in the fourth, fifth and sixth panels, the first and second panels being folded about the first foldline to register the first and second panels with one another with the transversely extending marginal edges thereof in transverse alignment with or inset from the marginal lines of perforations, adhesive portions along the first and second panels inset from the marginal edges thereof to secure the first and second panels to one another, respectively, to form a return envelope, the first and second panels being folded about the second foldline such that the third panel and the first and second panels register with one another, the registering first, second and third panels being folded about the third foldline to register with the fourth panel, the registering first, second, third and fourth panels being folded about the fourth foldline to register with the fifth panel, adhesive along the marginal tear strips of one of the fourth and fifth panels to secure the fourth panel and the fifth panel to one another, with the first, second and third panels within the fourth and fifth panels with transverse marginal edges thereof in transverse alignment with or inset from the marginal lines of perforations, the fourth and sixth panels being folded about the fifth foldline to register with one another and adhesive between the sixth and fourth panels to secure the sixth and fourth panels to one another.

In a still further preferred embodiment according to the present invention, there is provided a method for producing a mailer formed of a single ply having longitudinally and transversely extending edges, first, second, third, fourth, fifth and sixth panels, and first, second, third, fourth and fifth foldlines transversely spaced one from the other and extending in a longitudinal direction, comprising the steps of providing a single ply of web material, imaging information on at least one side of the web, forming transversely extending edges along the first, second and third panels inset from the transversely extending edges of the fourth, fifth and sixth panels, applying transverse adhesive lines along transversely extending marginal areas of the first and second panels of the web, folding the first and second panels of the web about a first foldline into registration with one another, with the transverse adhesive lines adhering the first and second panels to one another to form a return envelope, forming a return envelope flap in the third panel, folding the first and second panels and the third panel of the web into registration with one another about a second foldline between the flap and the first panel, folding the first, second and third panels into registration with the fourth panel about a third foldline, subsequently applying transverse adhesive lines to one of the fourth and fifth panels along marginal areas thereof, folding the registering first, second, third and fourth panels about a fourth foldline into registration with the fifth panel with the adhesive securing the fourth and fifth panels to one another, subsequently applying transverse adhesive lines to marginal areas of one of the sixth and fourth panels of the web, folding the sixth panel and the first through fifth panels into registration with one another so that the sixth panel is in juxtaposition with the fourth panel whereby the adhesive lines applied to one of the fourth and sixth panels adheres the fourth and fifth panels to one another to form a single-part statement and after adhering the fourth and fifth panels to one another, severing each of the single-part statements from the web of material.

Accordingly, it is a primary object of the present invention to provide a novel and improved single-part statement in the form of a mailer and formed of a single ply having an outgoing mailing envelope, a return business envelope, a statement and a payment coupon, all forming part of the single ply, together with novel and improved insert, e.g., payment coupon and remittance, locating glue spots along the return envelope to preclude damage to, or cutting of, the insert.

BRIEF DESCRIPTION OF THE DRAWINGS

FIG. 5 is a view of the web of FIG. 4, with the panels folded about a second foldline;

FIG. 6 is a view similar to FIG. 5 illustrating the panels folded about registering third and fourth foldlines and with additional adhesive lines applied subsequent thereto;

FIG. 8 illustrates: the web being severed along transverse cutlines to form the discrete mailers hereof;

FIG. 9 is a front elevational view of the return envelope, with the outer dashed lines illustrating potential cutlines for automatic mail openers and the interior dashed lines illustrating the insert within the return envelope;

FIG. 10 illustrates a return envelope cut by an automatic mail opener with the envelope sides separated, exposing the insert for removal;

BEST MODE FOR CARRYING OUT THE INVENTION

Reference will now be made in detail to a present preferred embodiment of the invention, an example of which is illustrated in the accompanying drawings.

Figure 1:
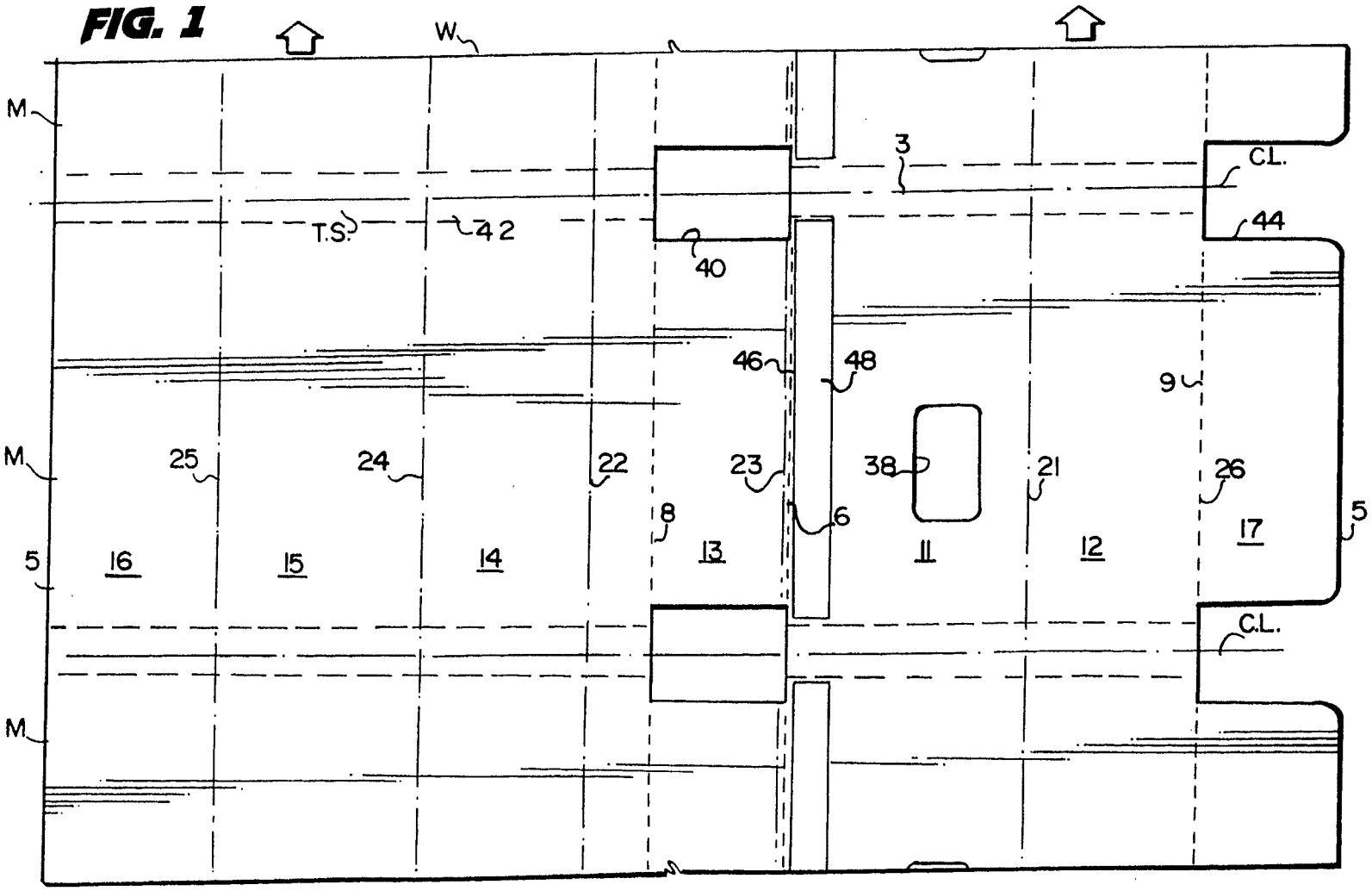
FIG. 1 is a plan view of a portion of a web illustrating a single-part statement mailer and portions of adjoining mailers as part of the web, with foldlines and lines of perforation superposed onto the web to illustrate their respective locations, all in accordance with the present invention.

Referring now to the drawings, particularly to FIG. 1, there is illustrated a single-ply paper web, designated W, for movement in a longitudinal direction indicated by the arrows in FIG. 1. Single-part statement mailers M are formed continuously from web W. As seen in FIG. 1, each mailer, prior to folding and gluing, comprises a single laid-out flat sheet which includes transversely longitudinally extending edges 3 and 5, respectively, relative to the direction of web travel. Edges 3 extend in the transverse direction a distance greater than longitudinal edges 5 extend in the longitudinal direction. In final assembly, each mailer is die-cut, printed, folded, glued, perforated and severed along cutlines C.L. to form discrete mailers. It will be appreciated in FIG. 1 that the dashed lines extending in the transverse direction illustrate various perforation lines applied to the mailer, as will become clear, subsequent to its folding about foldlines illustrated by the dot-dashed lines extending in the longitudinal direction, i.e., the direction of web travel. The longitudinally extending dashed lines represent lines of perforations formed in the web prior to any folding.

The web W comprises a continuous single ply of paper from which is formed a plurality of mailers M, a portion of an adjacent leading mailer M1 in the direction of web travel and a portion of a trailing mailer M2 in the direction opposite the direction of web travel being illustrated in FIG. 1. Each mailer is divided into a plurality of panels. For clarity of the following description of this first embodiment, the first, second, third, fourth, fifth, sixth and seventh panels are designated 11, 12, 13, 14, 15, 16 and 17, respectively. When the mailer is completed as illustrated in FIG. 8, the single ply forming mailer M will be folded about first, second, third, fourth, fifth and sixth foldlines which, for clarity of the following description, are designated 21, 22, 23, 24, 25 and 26, respectively. As will be appreciated from the following description, the panels, either singly or in combination, form portions of a return envelope, a forwarding mailing envelope, a statement and a return payment coupon.

Also, the mailer has; preprinted information on one or both sides and on one or more of the panels. The preprinted information can be information of a non-personalized general or generic nature applicable to all recipients of the mailer, as well as intelligent or personalized information which may be computer-generated and contain information specific to a particular addressee. For example, the present single-part statement may be used as a bank credit card statement. In that preferred form, the return envelope, which comprises panels 11 and 12 in mailer M, may have information common to the entire mailing by the issuer of the credit card statement. Thus, the return address of the sender, as well as other information informing the user how to use the envelope, as well as postal barcode areas, stamp areas, and return address areas may be preprinted on and common of panels 11 and 12. The account statement itself, which may comprise combined areas of panels 14, 15 and 16, as well as a portion of panel 13, may have both non-personalized and personalized intelligent computer-generated information. For example, the non-personalized information may include standard identifiers for the personalized intelligent information, such as an account number, payment due date, total credit line, cash advance limit, new balance, available credit line, available cash limit, sales date, posting date, reference number, activity since last statement, amount, account summarizes and other items which would be common to all account statements. Additionally, these account statement areas of panels 14, 15 and 16 13 may also include personalized intelligent information specific to that account, for example, the actual posting date, the identity of the retailer through which the charge was incurred, the actual amount, the actual interest amount, finance charges, charges to date and other information specific to that account. Preferably, such intelligent information is printed on the side of the single ply which will be sealed within the mailer, ensuring the privacy of the information, i.e., the side of the ply facing upwardly in FIG. 1. Additionally, a portion of the panels, for example, panel 14, may comprise marketing or advertising materials and this likewise can be either non-personalized generic information for all addresses personalized intelligent information based on computerized information concerning the specific addressee. i.e., the account holder. Further, a payment coupon may also form part of the mailer M. Thus, for example, the inset portion of panel 13 may comprise a payment coupon having both non-personalized generic and personalized intelligent information on the coupon. Such generic information might include a change of address information block or a block labelled amount due. Other types of non-personalized information which can be printed on one or both sides of the single ply and in the various panels will readily be apparent to those skilled in the art, particularly by reference to current standard account statements, payment coupons and return envelopes. The specific personalized intelligent information may include, for example, the account balance, minimum payment due, and due date for that particular month and statement and this likewise will be apparent to those of skill in that art.

The opposite side of the mailer M from that illustrated in FIG. 1, may likewise contain both non-personalized generic and personalized intelligent information. For example, the name and address of the recipient of the mailer may be printed on the back side of panel 15 which forms the mailing address of the outgoing mailer upon final assembly. Mailer opening information may be disposed on the back side of any one or more of the panels. For those back panels which will be wholly enclosed within the mailer when forwarded, the terms and conditions of the account: statement may be preprinted. Likewise, on the back side of the payment coupon panel 13, various information may be requested from the particular recipient, for example, in the event there is a disputed item on the account statement.

Turning now to the actual formation of the mailer M in the web W and with reference to FIG. 1, the web is first longitudinally perforated at transversely spaced locations as needed for the particular statement mailer. Thus, lines of perforation are formed at 6 and 8 in FIG. 1 to define the payment coupon portion of panel 13 and at 9 to define a tear-off line for the return envelope bang-tail panel 17. The lines of perforations may be formed in the web and the web rewound in coil form for later use. Conversely, the lines of perforations may be provided as the web is removed from the coil stock prior to printing. The web is then printed with both the non-personalized generic and personalized intelligent information on one or both sides and in the various portions of the mailer panels, as illustrated by the various printing machines 30, 32 and 34 in FIG. 12. This imaging or printing may be accomplished by MIDAX print engines 30 and 32, as described in U.S. Pat, No.

5,132,713, and by a Tricon print station 34. The Tricon print station 34 may comprise a Tricon UltraJet TM printer, a product of Trident, Inc. of Brookfield, Conn., identified as the Horizontal Headboard. This printer is a lightweight printer for specialized printing. It will be appreciated that the web W is taken from reel 36 and passed through the print machines to complete the printing process.

Figure 12:
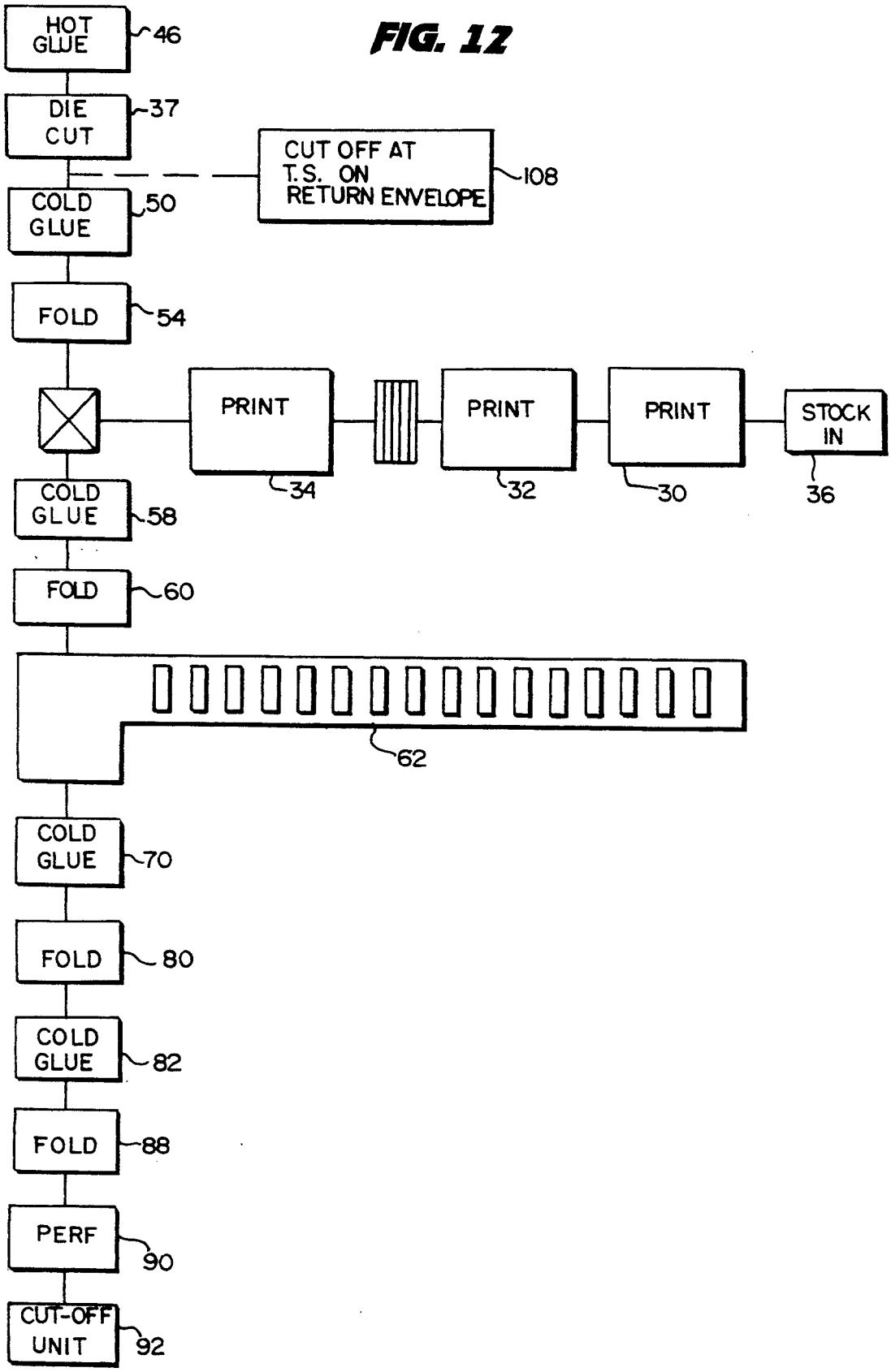
FIG. 12 is a diagrammatic illustration of a method of forming the mailer hereof.

As illustrated in FIG. 12, the printed web is then turned 90° and advanced to a hot glue station 46 (FIG. 12) where hot glue or adhesive 48 is applied to the return envelope flap 46 which forms part of panel 11 directly adjacent foldline 23. The hot glue thus forms a rewettable adhesive for the closure flap of the return envelope. After the glue for the return envelope flap is applied, the web is advanced through a die-cut unit 37 where various die cuts are formed in the web. For example, and referring to FIG. 1, a die-cut window 38 for the return mailer is formed at station 37 in panel 11. Further, a portion of panel 13 is die cut to form transversely extending edges 40 inset from transverse cutlines C.L., as well as inset from transversely extending perforation lines 42 later formed in the mailer after folding and gluing, as will become apparent from the ensuing description. Also, panel 17 is die cut to form edges 44 inset from the corresponding lines of perforations 42. The die cutting about the bang-tail panel 17 and the remittance coupon portion of panel 13 cuts those portions of the mailer to an appropriate size so that neither the bang-tail nor the coupon have to be folded to be inserted into the return envelope. As will be appreciated, the lines of perforations form with the cutlines C.L. tear strips T.S. in the transverse margins of the completed mailer. For identification herein, the tear strips are labelled T.S. preceded by the number of the panel of which the tear strips are a part. It will also be appreciated that the panel 17, when die cut to form inset edges 44, forms a bang-tail panel which is provided in the preferred form the mailer. The bang-tail panel, however, is not necessary to the mailer and the mailer may be provided without such panel.

Figure 2:
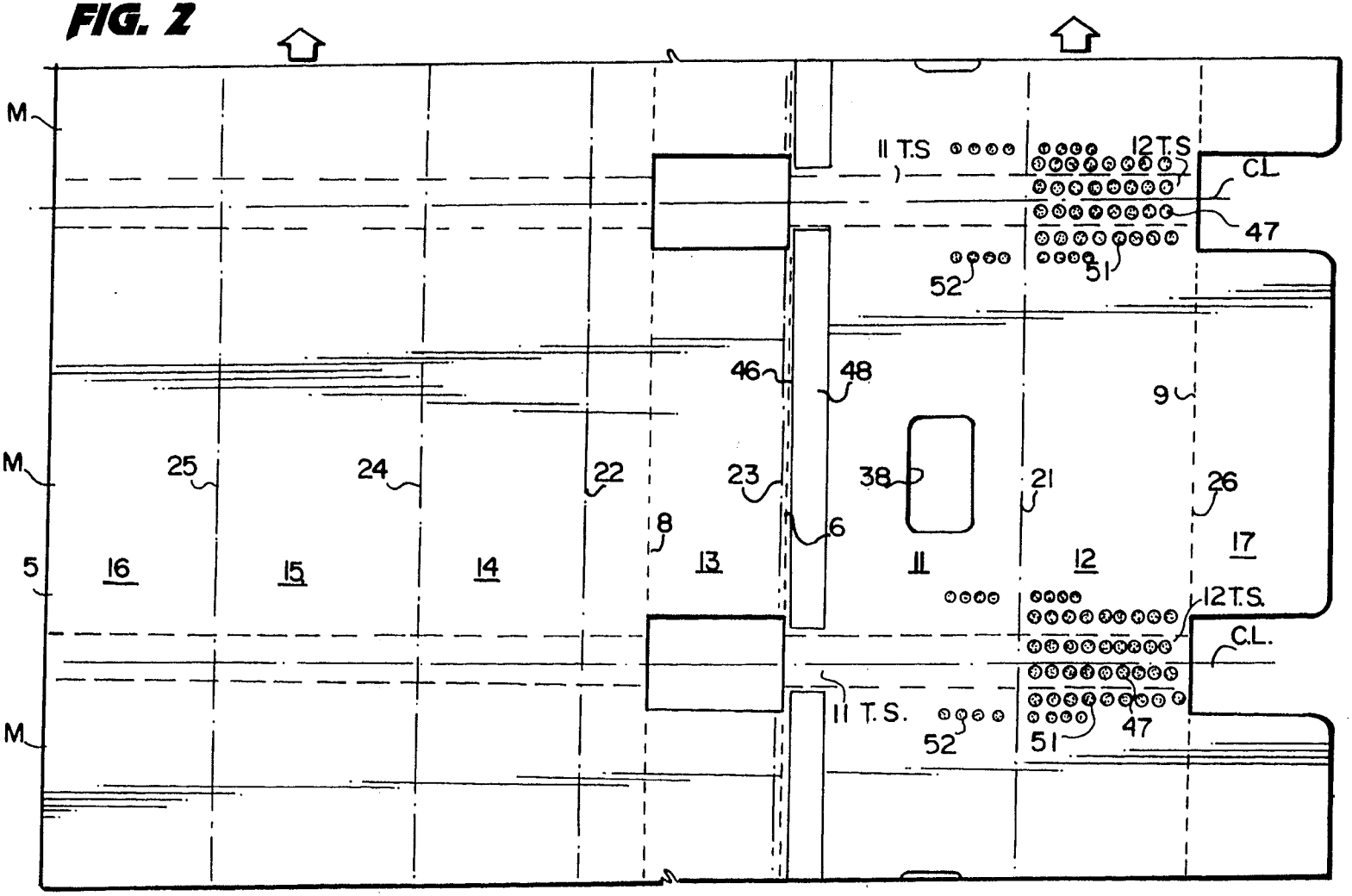
FIG. 2 is a view similar to FIG. 1 illustrating a first application of adhesive to the web.

After die-cut station 37, the web is advanced and a cold glue is applied to the web, at a subsequent cold glue station 50 by glue nozzles, to those portions of the panels which will be immediately subsequently folded and adhered to one another. Thus, at cold glue station 50 (FIG. 12), cold glue 47 is applied in the regions of the marginal tear strips 12T.S. of panel 12 on both sides of subsequently formed cutlines C.L. Particularly, and referring to FIG. 2, the cold glue is applied to areas between subsequently applied perforation lines 42 such that the cold glue lies along adjoining tear strips of adjoining mailers in the direction of web travel. A cold glue line 51 is additionally applied at 51 just inside the perforation lines 42 to seal the opposite end edges of panels 11 and 12 to one another when subsequently folded to form the return envelope. Fugitive glue spots 52 are also disposed on panels 11 and 12 inwardly of glue lines 51 and on opposite sides of foldline 21. The fugitive glue spots 52 extend along the edges of the return envelope from the foldline 21 a limited distance, for example, less than half the height of the return envelope. As used herein, the term "glue line" and "glue spots" are used interchangeably, it being appreciated that a continuous line of glue and spaced spots of glue may be used in the glue applications in the present invention. The terms "adhesive" and "glue" are also used interchangeably.

Figure 3:
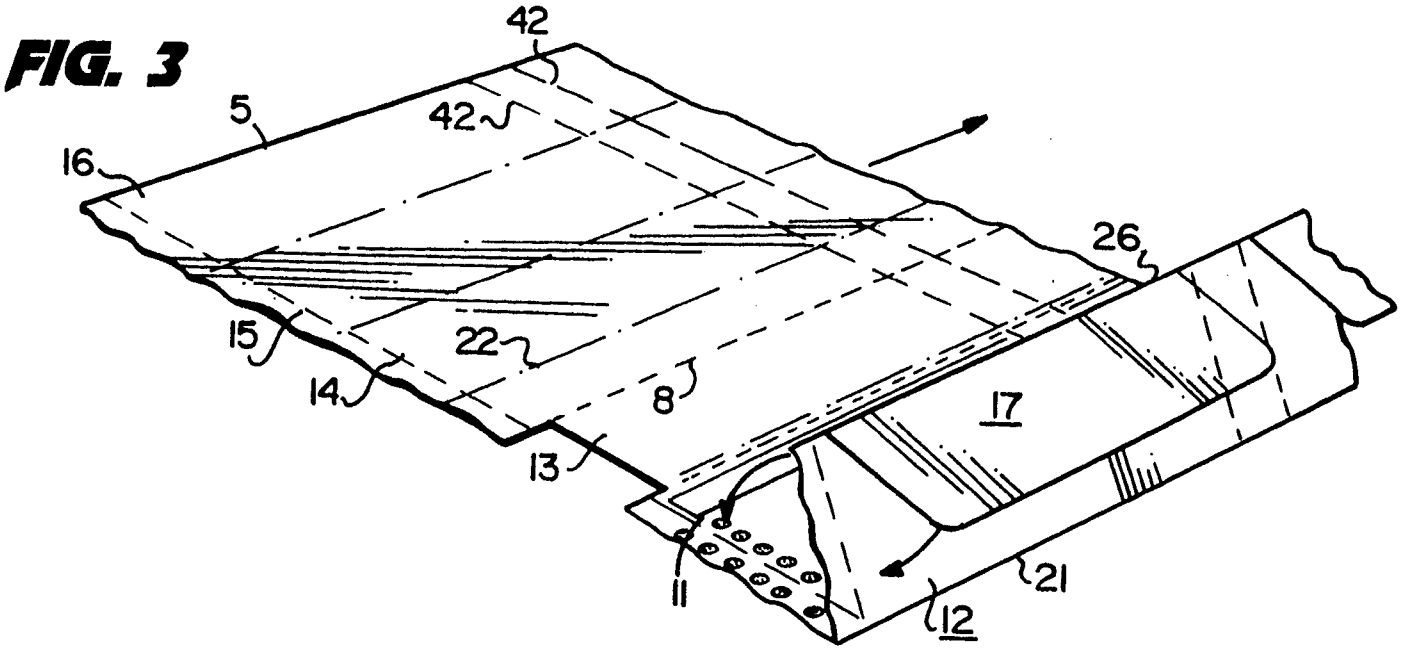
FIG. 3 is a perspective view of the web being folded about a first foldline to form a return envelope for each mailer in the web.

Subsequent to application of cold adhesive lines 47, 51 and 52, the web is plow-folded at plow-folding station 54 to fold panels 11 and 12 about foldline 21 to register panels 11 and 12 one with the other and the marginal tear strips 11T.S. and 12T.S. one with the other. Thus, the marginal tear strips of panels 11 and 12 are adhered to one another, the margins of the return envelope inside of lines of perforations 42 are adhered to one another, and interior portions of the return envelope edges adhere to one another along fugitive glue lines 52. These adhered fugitive glue lines form an inside guide for receiving an insert, e.g., a payment coupon and a remittance, whereby the insert is spaced from the end edges of the return envelope. When panels 11 and 12 are plow-folded, the panel 17, if used, is also folded about foldline 26 in a reverse direction to overlie the back face of panel 12 as illustrated in FIG. 3.

Figure 4:
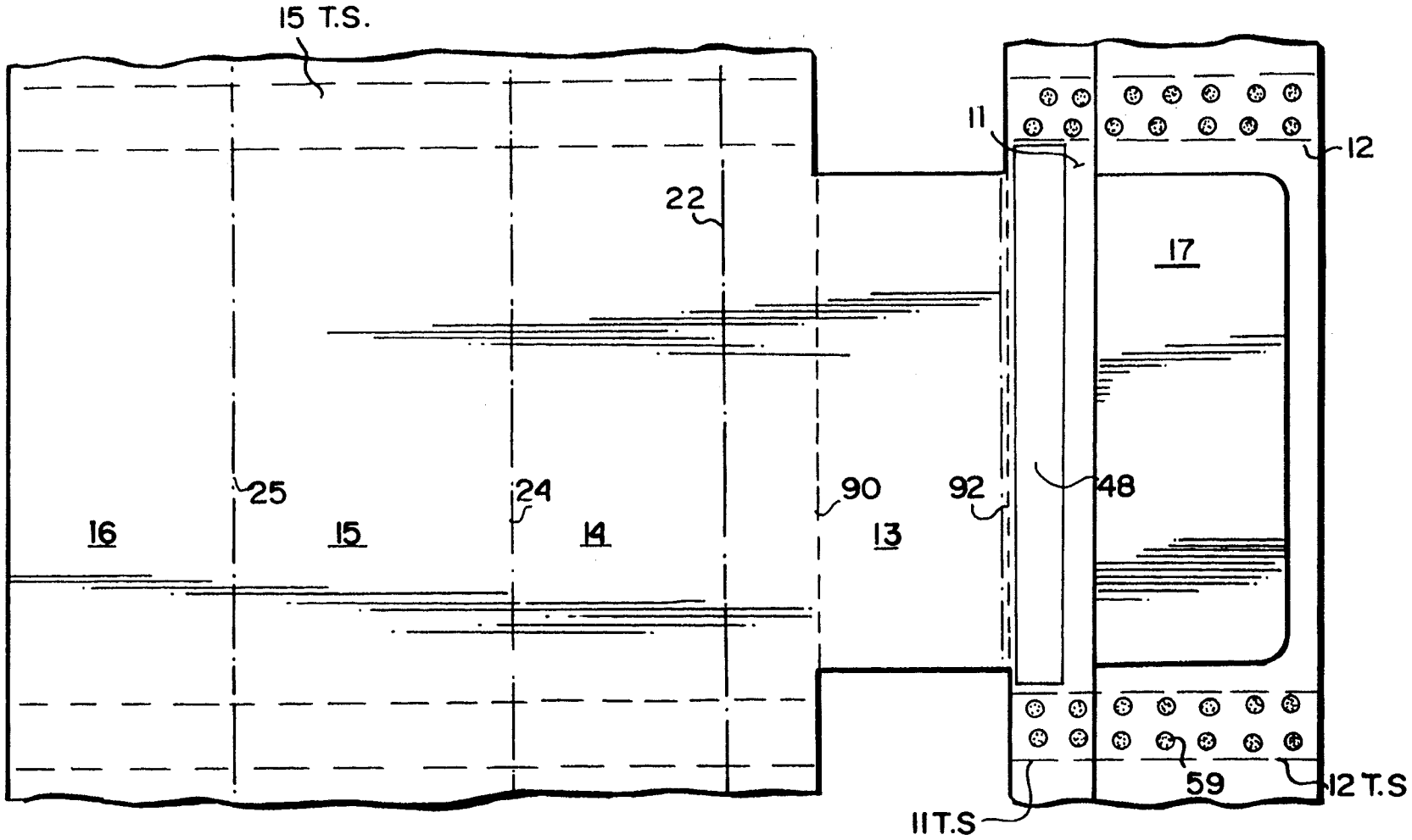
FIG. 4 is a view similar to FIG. 1, with the return envelope formed and additional adhesive lines applied to the web.
Figure 7:
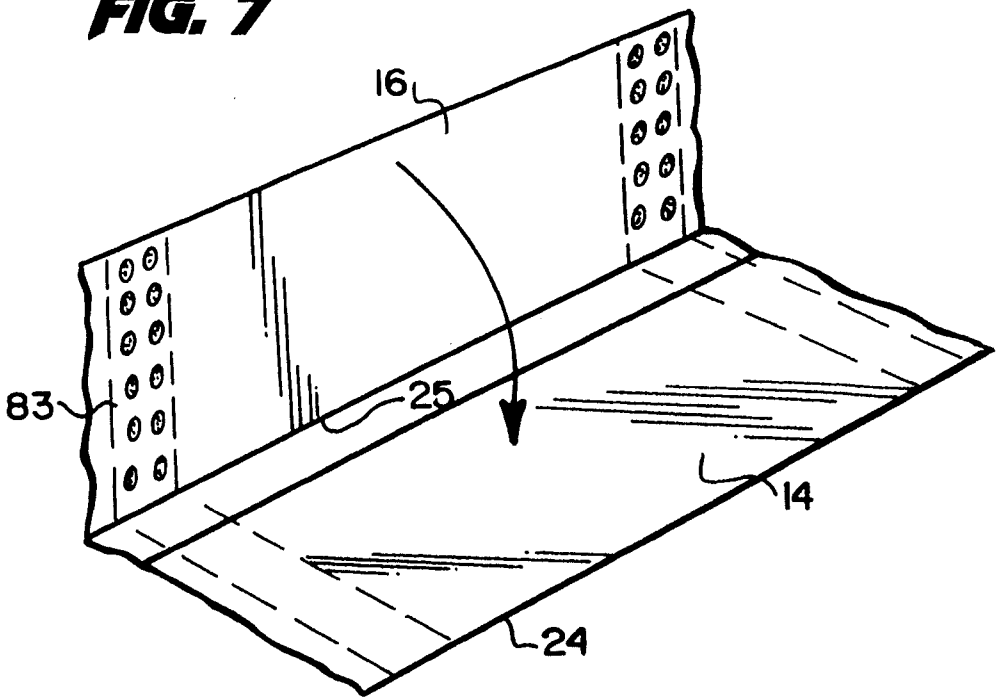
FIG. 7 is a perspective view of the sixth panel being folded about the fifth foldline and into registration with the registering first through fifth panels.

Turning to FIG. 4, web W, with the return envelope formed, is then passed through a second cold glue station 58 (FIG. 12) where additional cold glue lines 59 are applied to the tear strips 12T.S. forming part of panel 12 and a portion of the tear strip 11T.S. of panel 11. Web W is advanced to a further plow-fold station 60 where the panels 13, 11 and 12 are folded about foldline 22 such that panel 13 lies in registration with panel 14 and registering panels 11 and 12 register with panel 15, as illustrated in FIG. 5. Consequently, the tear strips 15T.S. of panel 15 adhere to the tear strips 12T.S. of panel 12 and the portion of the tear strips 11T.S. of panel 11 to which glue was applied.

With the web folded about foldline 22 as illustrated in FIG. 5 and prior to the next adhesive application, one or more inserts may be disposed within the mailer in loose fashion such that when the recipient opens the mailer, the inserts fall out or can be individually removed. To accomplish this, an intelligent inserter 62 (FIG. 12) is provided. Inserter 62 cooperates with the web line to provide one or more inserts 63 (FIG. 11) on the web as the web passes the discharge end of the inserter (sixteen insert stations being illustrated for inserting sixteen different types of inserts). The inserts may contain personalized intelligent information preprogrammed in conjunction with the printers 30, 32 and 34 such that designated inserts may be provided mailers addressed to certain addressees based on computer-generated information, e.g., demographic information. Of course, non-personalized inserts may also be inserted into the mailers as they are formed. The inserts, when employed in the mailer, are located on top of the mailing address side of the return envelope, i.e., on top of panel 11.

With or without one or more inserts, web W advances to a third cold glue station 70. At station 70, cold glue lines 73 are applied to the portions of tear strips 14T.S. of panel 14 exposed by the inset edges 40 of panel 13. Glue lines 73 also extend along overlying tear strip portions 74 of panel 13. When the registering panels 13 and 14 are folded at fold station 80 (FIG. 12) about registering foldlines 23 and 24 into registration with registered panels 11, 12 and 15, as well as the bang-tail panel 17 when used, the adhesive line 73 secures tear strip portions 74 of panel 13 along the tear strip 11T.S., as well as the portions of tear strip 14T.S. of panel 14 to the registering portion of tear strip 11T.S. of panel 11 as illustrated in FIG. 6.

The web is then advanced to a cold glue station 82 (FIG. 12) where cold glue lines 83 are applied along the tear strips 16T.S. of panel 16. Additionally, cold glue is applied along the longitudinally extending edge 5 of panel 16. The web is then advanced to a folding station 88 where panel 16 and panels 11, 12, 13, 14 and 15, as well as panel 17 if a bang-tail panel is used, are folded into registry with one another. The glue seals the mailer along the tear strip margins.

The web is then advanced to a perforation station 90 (FIG. 12) where the perforation lines 42 are applied along the opposite margins of the mailer inset from transverse edges 3 and through the multiple panels. The web is then passed through a cutoff unit 92 where the mailers are cut from the web along cutlines C.L. to form discrete mailers M. As illustrated in FIG. 8, the web with the discrete mailers folded and glued advance in the direction of web travel, i.e., in the direction of the arrow in FIG. 8. The slitters slit the web along cut lines C.L., bisecting the transversely extending lines of perforations 42, forming the mailer M. Note in FIG. 8 that the mailer M has marginal tear strips T.S. along its opposite ends defined by the lines of perforations 42.

Figure 11:
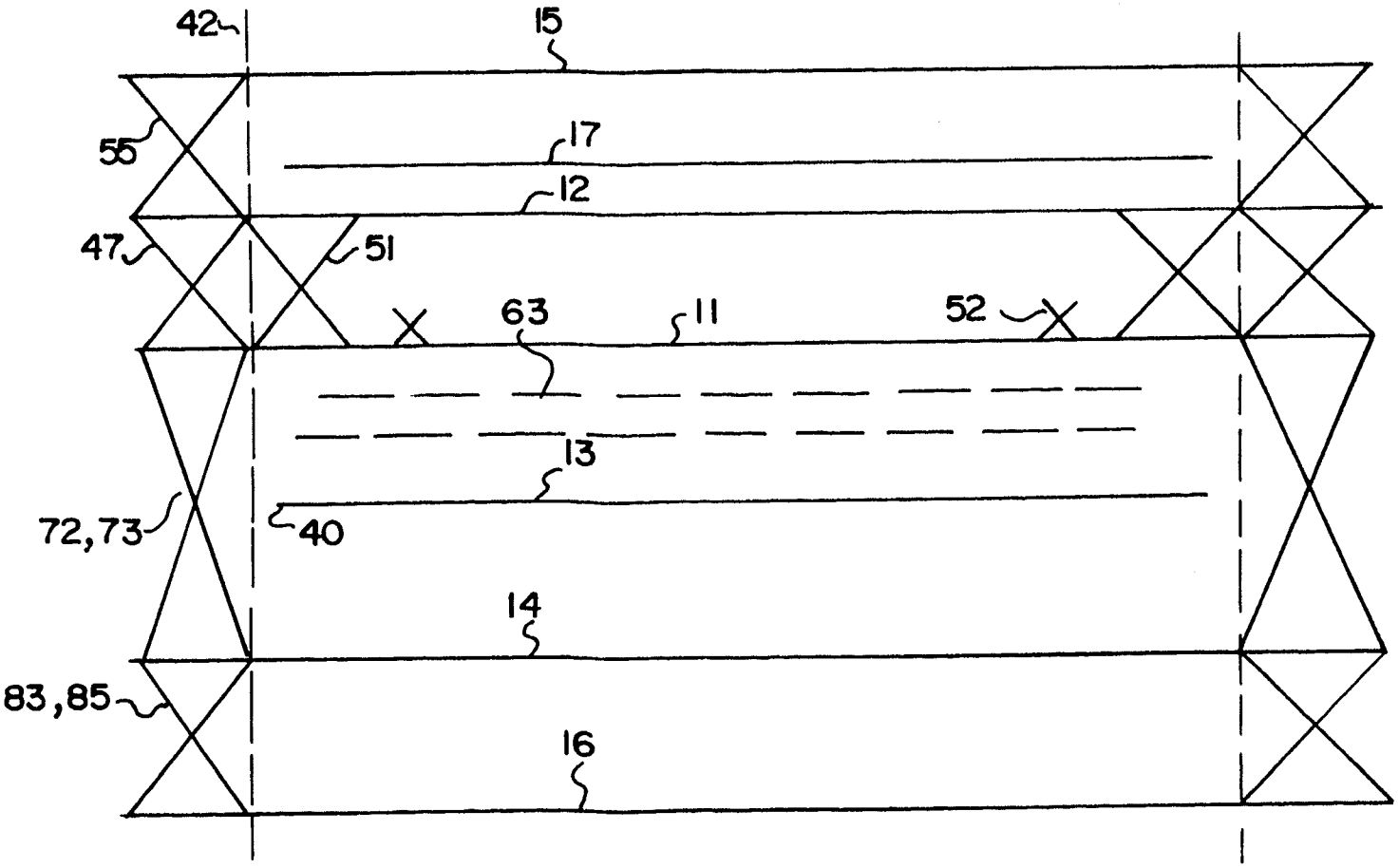
FIG. 11 is an enlarged schematic cross-sectional view taken along a line 11–11 in FIG. 8 and extending in the direction of web travel illustrating the various adhesive attachments between the tear strips of the various panels.

To facilitate a further understanding of the mailer of the present invention, reference is made to FIG. 11, which is a schematic view through a mailer looking along the lines 11—11 in FIG. 8. The juxtaposed panels are illustrated in the order of their appearance in the mailer and the glue lines between the tear strips of the mailer are illustrated. Additionally, the bang-tail panel 17 is disposed between panels 12 and 15 and the inserts 63 are illustrated by the dashed lines disposed between panels 11 and 13. Note that the glue lines extend between the tear strips of panels 11 and 14 whereby the inserts are prevented from slipping from the mailer through the opposite ends of the mailer. In FIG. 11, the panel 13 is illustrated with its end edges 40 inset from the lines of perforations 42. The margin 74 in the background portion of the panel 13 is not illustrated.

When a recipient receives the mailer, both marginal tear strips T.S. comprised of strips 11T.S., 12T.S., 13T.S., 14T.S., 15T.S. and 16T.S. at the opposite ends of the mailer may be removed along the lines of perforations 42. In removing those tear strips, it will be appreciated that the mailer can be unfolded to a single-ply form with panels 11 and 12 remaining secured to one another by the glue lines 51 and fugitive glue lines 52 to form the return envelope. The account statement information, for example, may be read by the recipient from panels 16, 15 and 14, and the payment coupon in panel 13. If all is in order, the recipient may remove the account statement from the payment coupon portion of the panel 13 by detaching the account statement along longitudinally extending line of perforations 8. Additionally, the coupon statement itself may be detached from the return envelope flap along line of perforations 6. The payment coupon, because its edges 40 are inset, may be inserted into the return envelope, together with a remittance, and within the fugitive glue lines 51. The return flap is then moistened, folded over a foldline and sealed to the outer face of panel 12. If the bang-tail panel 17 forms part of the mailer, it is removed before the return envelope is sealed by tearing along the line of perforations 9.

When the return envelope is received by the payee, automatic openers may be used to remove margins of the return envelope. For example, automatic slitters may slit off an eighth to a quarter inch of the top margin, as well as end margins of the return envelope, to enable suction devices to pull the panels apart, exposing the contents of the return envelope for extraction. It will be appreciated that the contents, including the payment coupon and payment, lie within the fugitive glue lines and thus are out of the way of the automatic mail opening cutters whereby the payment coupon and payment are free of damage and mutilation.

Figure 13:
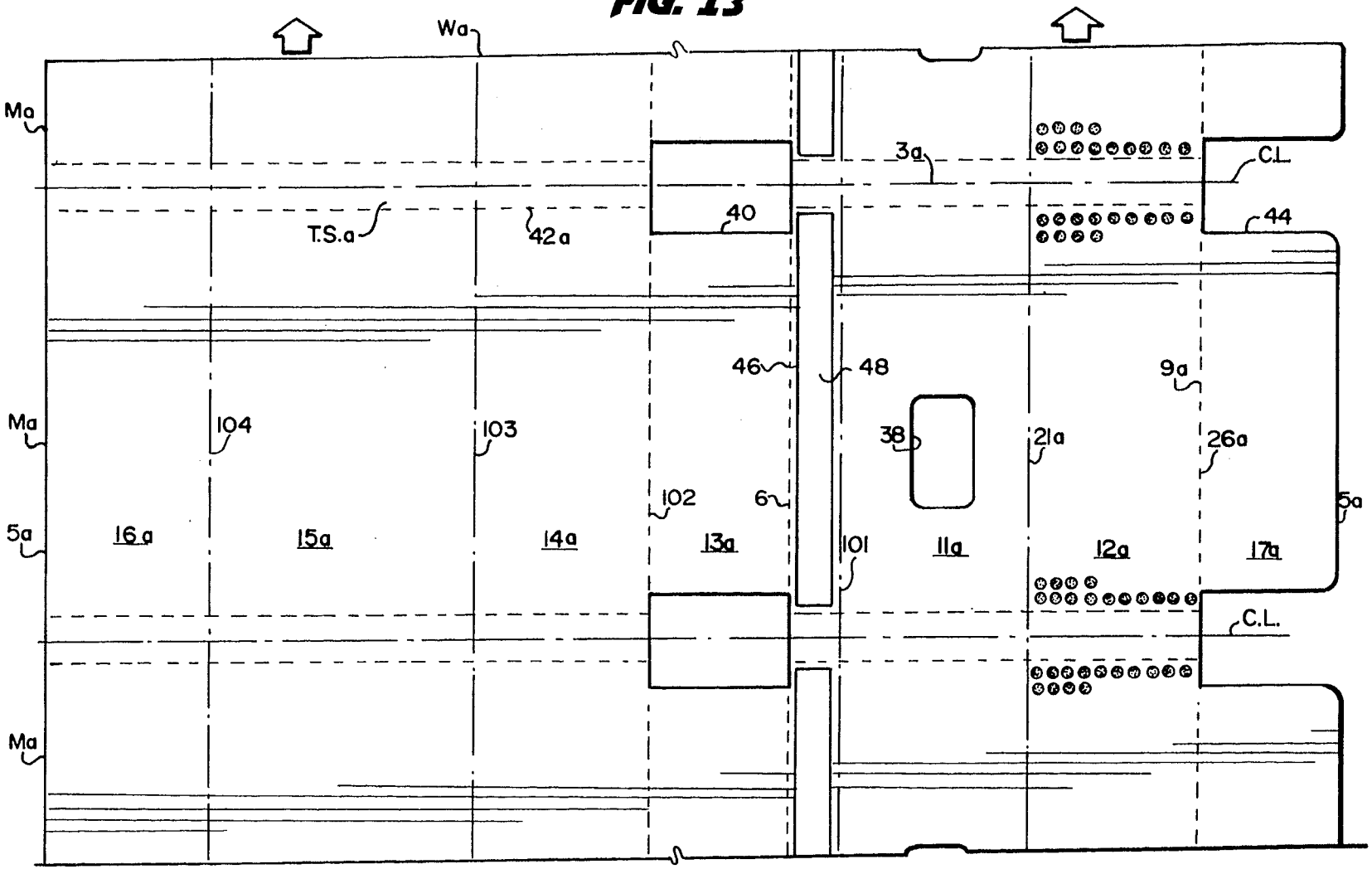
FIG. 13 is a view similar to FIG. 1 illustrating a further embodiment of a single-part statement mailer according to the present invention.
Figure 14:
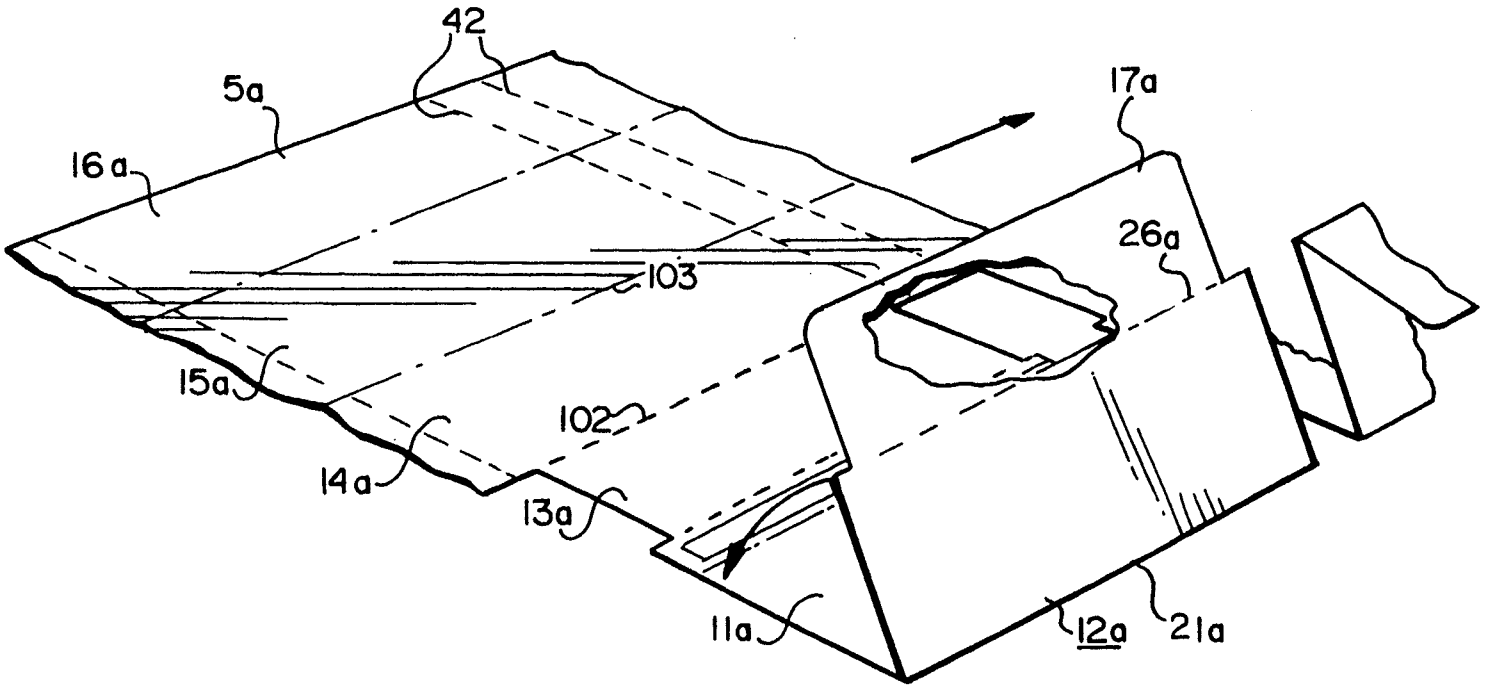
FIG. 14 is a perspective view of the embodiment of FIG. 13 illustrating the return envelope fully formed, with the tear strips removed, and being folded over onto the next-adjacent panel.
Figure 15:
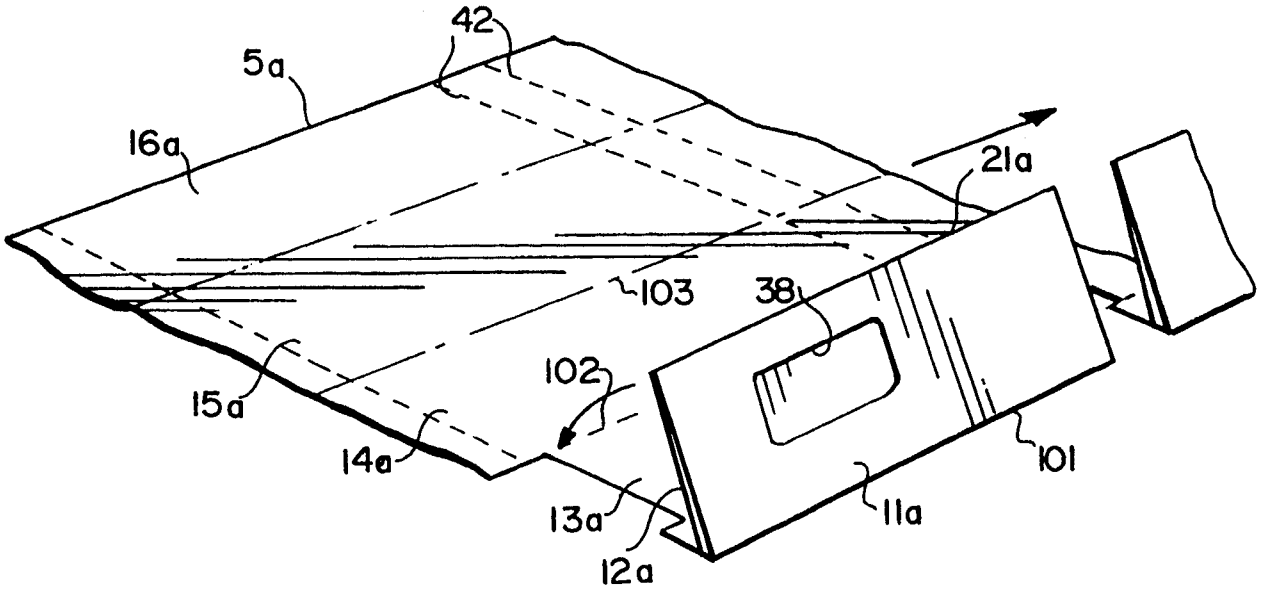
FIG. 15 is a view similar to FIG. 14 illustrating a further folding of the web.
Figure 16:
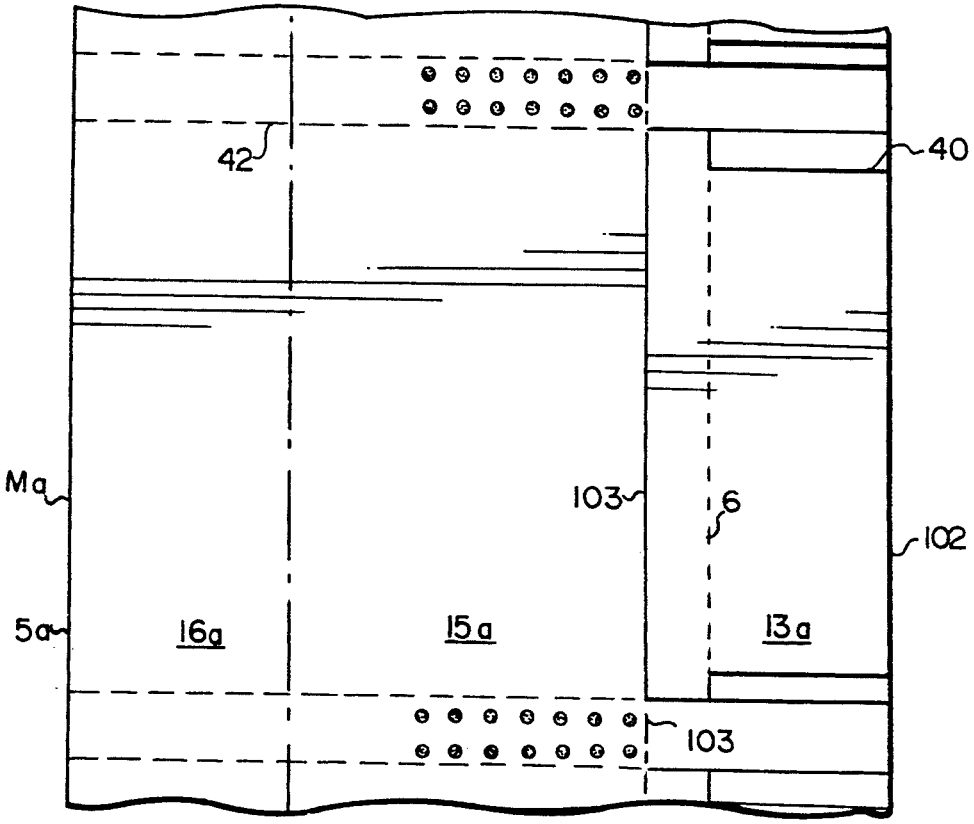
FIG. 16 is a view similar to FIG. 15 illustrating the application of additional glue spots and the registering panels being folded over a further foldline.

Referring now to the embodiments hereof illustrated in FIGS. 13–17, wherein like reference numerals are applied to like parts, followed by the suffix "a", there illustrated a mailer Ma formed of six panels 11*a*, 12*a*, 13*a*, 14*a*, 15*a* and 16*a*. A seventh panel 17*a* is also included when a bang-tail is provided the return envelope. As illustrated in FIG. 13, adjacent mailers are shown in the web Wa, with each mailer being defined by transverse and longitudinally extending edges 3*a* and 5*a*. Web Wa is printed as previously described width respect to the printers 30, 32 and 34 and is also passed through the die-cut station 37 and the following hot glue station 46, where the rewettable adhesive is applied to the return envelope flap.

In this embodiment, however, the foldlines, sequence of gluing and the folding of the panels is different than in the prior embodiment, with the exception of foldlines 21*a* and 26*a*. Thus, the return envelope comprised of panels 11*a* and 12*a* is formed similarly as in the previous embodiment, but with glue lines applied to one of the panels 11*a* and 12*a* only in the areas inset from the lines of perforations 42*a* such that, upon folding the panels 11*a* and 12*a* about foldline 21*a*, panels 11*a* and 12*a* form a return envelope. After the return envelope is formed, or before it is folded to form the return envelope, and as illustrated in 108 at FIG. 12, the web is passed through a cut-off station 108 where the marginal portions of panels 11*a* and 12*a*, which would otherwise form the tear strips as in the previous embodiment, are cut from the web, Consequently, the marginal edges of the return envelope formed in the web Wa are aligned with or slightly inset from the lines of perforations 42*a*.

Figure 17:
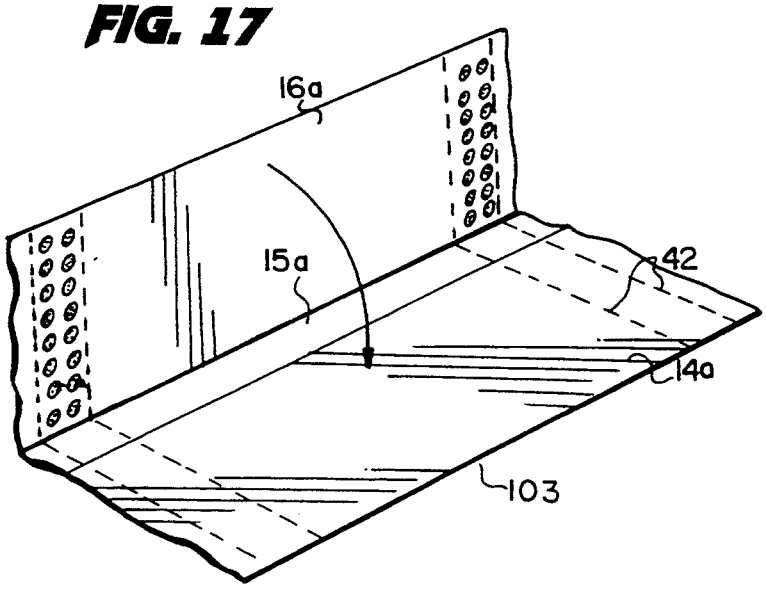
FIG. 17 is a perspective view illustrating the final application of glue and folding of the mailer to form the complete mailer of tile embodiment of FIG. 13 hereof.

With the return envelope thus formed, it will be that panel 17*a* overlies panel 13*a* and foldlines 9*a* and 101 register one with the other. In that configuration, the web Wa is advanced to a second folding station where the return envelope is folded about the registering foldlines 9*a* and 101 to register panels 11*a*, 12*a* and 17*a* with panel 13*a*. Note that the foldline 21*a* registers with the foldline 102 and that none of the edges of panels 11*a*, 12*a*, 17*a* and 13*a* lie outside the lines of perforations 42*a*. The web Wa is then advanced to a third folding station where the registering panels 13*a*, 17*a*, 11*a* and 12*a* are folded about foldline 10 and registered with panel 14*a*. The web is then advanced to a gluing station where glue is applied to the margins of one of panels 14*a* and 15*a*. Upon advancement of the web through a subsequent folding station, the registering panels 14*a*, 11*a*, 12*a*, 17*a* and 13*a* are registered with panel 15*a*, with the glue lines in the marginal tear strips adhering panels 14*a* and 15*a* to one another, thus sealing off the opposite inset ends of panels 11*a*, 12*a*, 17*a* and 13*a*. Web Wa is subsequently advanced to a final glue station where glue is applied to the tear strips of one of panels 16*a* and 14*a*, glue being applied to panel 16*a* as illustrated in FIG. 17. A subsequent folding station registers panel 16*a* with the registered panels 4*a*, 11*a*, 12*a*, 17*a*, 13*a* and 15*a*. It will be appreciated that inserts, similarly as in the prior embodiment, may be received in web Wa at any stage subsequent to the formation of the return envelope and the adhesive securement of the panels 14*a* and 15*a* to one another.

It will be appreciated that when the recipient receives a mailer of this type, the tear strips lie only on panels 16*a*, 14*a* and 15*a*, the margins of panels 17*a* and 13*a* having been inset by the die-cutting process and the margins of the return envelope formed by panels 11*a* and 12*a* having been cut to lie along or lie slightly inset from the lines of perforations 429 forming the tear strips in panels 14*a*, 15*a* and 16*a*. In this manner, when the recipient removes the marginal tear strips from the statement, the margins of the return envelope have previously been cleanly cut off in the mailer manufacturing process. Thus, there is ensured a cleanly cut margin on the return envelope which prevents any misalignment in the automatic mail opening machine in the event that the tear-off strips are not torn cleanly from the return envelope. Additionally, the return envelope flap may not be properly folded over the return envelope, causing bubbling or skewing of the flap, leading to misalignment of the slitter blades in the automatic opener. By folding the return envelope initially along a scoreline beneath the rewettable glue flap and above the return envelope: pocket, the folding of the return envelope flap about the appropriate foldline by the receipt of the mailer is facilitated, avoiding any skewing or bubbling of the return envelope flap.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A mailer comprising:

a single ply having longitudinally and transversely extending edges, first, second, third, fourth, fifth and sixth panels, and first, second, third, fourth and fifth foldlines transversely spaced one from the other and extending in a longitudinal direction;

a pair of marginal lines of perforations extending transversely along said ply generally parallel to said transversely extending edges and inset therefrom, respectively, defining marginal tear strips for the mailer in said first, second, fifth and sixth panels and at least one of said third and fourth panels;

said first and second panels being folded about said first foldline to register said first and second panels with one another and the marginal tear strips thereof with one another;

adhesive along at least one of said registering marginal tear strips of said first and second panels to secure said registering marginal tear strips to one another, and adhesive along at least portions of one of said first and second panels inset from said marginal lines of perforations to secure said first and second panels to one another, respectively, to form a return envelope;

said third, first and second panels being folded about said second foldline such that said third panel registers with said fourth panel and said first and second panels register with said fifth panel, the marginal tear strips of said second and fifth panels lying in opposition to one another and said third and fourth foldlines lying in registry with one another;

adhesive along at least one of the registering marginal tear strips of said fifth and second panels to secure said fifth and second panels to one another;

said registering third and fourth panels being folded about registering third and fourth foldlines to register with said registering first, second and fifth panels;

adhesive along at least one of the marginal tear strips of said first panel and the marginal strip of said one of said third and fourth panels to secure said first panel and said one panel to one another;

said sixth panel being folded about said fifth foldline to overlie said fourth panel; and adhesive along at least one of said sixth and said one of said third and fourth panels to secure said sixth and said one of said third and fourth panels to one another.

2. A mailer according to claim 1 wherein one of said third and fourth panels has transversely extending edges inset from the marginal lines of perforations of next-adjacent panels.

3. A mailer according to claim 1 wherein said first panel includes a return envelope flap having a longitudinally extending edge thereof adjacent said third foldline and adhesive applied along said return envelope flap.

4. A mailer according to claim 1 including a seventh panel in said ply adjacent said second panel, a sixth foldline between said second and seventh panels, said seventh panel being folded about said sixth foldline to lie in registration with said second panel and between said second and fifth panels in said mailer.

5. A mailer according to claim 4 wherein said seventh panel has transversely extending edges inset from the marginal lines of perforation of said second panel.

6. A mailer according to claim 1 wherein said ply is continuous and said panels lie in said continuous ply from one longitudinally extending edge of said ply to an opposite longitudinally extending edge of said ply in the order from one of said edges of said second, first, third, fourth, fifth and sixth panels.

7. A mailer according to claim 1 including a seventh panel in said ply adjacent said second panel, a sixth foldline between said second and seventh panels, said seventh panel being folded about said sixth foldline to lie in registration with said second panel and between said second and fifth panels in said mailer, said ply being continuous and said panels lying in said continuous ply from one longitudinally extending edge of said ply to an opposite longitudinally extending edge of said ply in the order from one of said edges of said seventh, second, first, third, fourth, fifth and sixth panels.

8. A mailer according to claim 1 wherein said third panel has transversely extending edges inset from the marginal lines of perforations of said first and fourth panels, a portion of the inset transversely extending edges of said third panel lying parallel to the transversely extending edges of said first, second, fourth, fifth and sixth panels.

9. A mailer according to claim 1 wherein one of said third and fourth panels has transversely extending edges inset from the marginal lines of perforations of next-adjacent panels, said first panel including a return envelope flap having a longitudinally extending edge thereof adjacent said third foldline and adhesive applied along said return envelope flap, said ply being continuous and said panels lying in said continuous ply from one longitudinally extending edge of said ply to an opposite longitudinally extending edge of said ply in the order from one of said edges of said second, first, third, fourth, fifth and sixth panels.

10. A mailer according to claim 1 wherein one of said third and fourth panels has transversely extending edges inset from the marginal lines of perforations of next-adjacent panels, said first panel including a return envelope flap having a longitudinally extending edge thereof adjacent said third foldline and adhesive applied along said return envelope flap, and a seventh panel in said ply adjacent said second panel, a sixth foldline between said second and seventh panels, said seventh panel being folded about said sixth foldline to lie in registration with said second panel and between said second and fifth panels in said mailer, said seventh panel having transversely extending edges inset from the marginal lines of perforation of said second panel said ply being continuous and said panels lying in said continuous ply from one longitudinally extending edge of said ply to an opposite longitudinally extending edge of said ply in the order from one of said edges of said seventh, second, first, third, fourth, fifth and sixth panels.

11. A mailer according to claim 1 including at least one insert within said mailer and between said first and third panels.

12. A mailer according to claim 1 wherein said pair of marginal lines of perforations define marginal tear strips for the mailer in said fourth panel, the adhesive between said sixth and said one panels being disposed between the marginal strips of said sixth and said fourth panels whereby said sixth and said fourth panels are secured to one another.

13. A mailer comprising:

a single ply having longitudinally and transversely extending edges, first, second, third, fourth, fifth and sixth panels, and first, second, third, fourth and fifth foldlines transversely spaced one from the other and extending in a longitudinal direction;

a pair of marginal lines of perforations extending transversely along said ply generally parallel to said transversely extending edges and inset therefrom, respectively, defining marginal tear strips for the mailer in said first, second, fifth and sixth panels;

said first and second panels being folded about said first foldline to register said first and second panels with one another and the marginal tear strips thereof with one another;

adhesive between said registering marginal tear strips of said first and second panels to secure said registering marginal tear strips to one another, and adhesive between portions of said first and second panels inset from said marginal lines of perforations to secure said first and second panels to one another, respectively, to form a return envelope;

said third, first and second panels being folded about said second foldline such that said third panel registers with said fourth panel and said first and second panels register with said fifth panel, the marginal tear strips of said second and fifth panels lying in opposition to one another and said third and fourth foldlines lying in registry with one another;

adhesive between the registering marginal tear strips of said fifth and second panels to secure said fifth and second panels to one another;

said registering third and fourth panels being folded about registering third and fourth foldlines to register with said registering first, second and fifth panels;

said sixth panel being folded about said fifth foldline to overlie said fourth panel; and adhesive between the marginal strips of said sixth and one of said panels to secure said sixth panel and said panels to one another in said mailer.

14. A mailer according to claim 13 wherein one of said third and fourth panels has transversely extending edges inset from the marginal lines of perforations of next-adjacent panels.

15. A mailer according to claim 13 wherein said first panel includes a return envelope flap having a longitudinally extending edge thereof adjacent said third foldline and adhesive applied along said return envelope flap.

16. A mailer according to claim 13 including a seventh panel in said ply adjacent said second panel, a sixth foldline between said second and seventh panels, said seventh panel being folded about said sixth foldline to lie in registration with said second panel and between said second and fifth panels in said mailer.

17. A mailer according to claim 13 wherein said ply is continuous and said panels lie in said continuous ply from one longitudinally extending edge of said ply to an opposite longitudinally extending edge of said ply in the order from one of said edges of said second, first, third, fourth, fifth and sixth panels.

18. A mailer according to claim 13 including a seventh panel in said ply adjacent said second panel, a sixth foldline between said second and seventh panels, said seventh panel being folded about said sixth foldline to lie in registration with said second panel and between said second and fifth panels in said mailer, said ply being continuous and said panels lying in said continuous ply from one longitudinally extending edge of said ply to an opposite longitudinally extending edge of said ply in the order from one of said edges of said seventh, second, first, third, fourth, fifth and sixth panels.

19. A mailer according to claim 13 including at least one insert within said mailer.

* * * * *